US007308935B2

(12) United States Patent
Doyle et al.

(10) Patent No.: US 7,308,935 B2
(45) Date of Patent: Dec. 18, 2007

(54) ROTARY PUMP STABILIZER

(75) Inventors: John P. Doyle, Calgary (CA); Lynn P. Tessier, Cochrane (CA); James L. Weber, Calgary (CA)

(73) Assignee: MSI Machineering Solutions Inc., Providenciales (TC)

( * ) Notice: Subject to any disclaimer, the term of this patent is extended or adjusted under 35 U.S.C. 154(b) by 247 days.

(21) Appl. No.: 10/908,974

(22) Filed: Jun. 2, 2005

(65) Prior Publication Data

US 2006/0272808 A1 Dec. 7, 2006

(51) Int. Cl.
*E21B 17/10* (2006.01)

(52) U.S. Cl. ..... 166/241.6; 166/212; 166/383

(58) Field of Classification Search ..... 166/241.6, 166/212, 217, 381, 383; 175/325.1, 81, 76
See application file for complete search history.

(56) References Cited

U.S. PATENT DOCUMENTS

| | | | | | |
|---|---|---|---|---|---|
| 1,856,469 | A | | 5/1932 | Crowell | |
| 1,906,771 | A | | 5/1933 | Sandstone | |
| 2,011,451 | A | | 8/1935 | Lockwood | |
| 2,228,630 | A | * | 1/1941 | Kail | 166/119 |
| 2,311,768 | A | | 2/1943 | McCray | |
| 2,490,350 | A | | 12/1949 | Grable | |
| 2,738,019 | A | | 3/1956 | Atkinson | |
| 3,380,528 | A | * | 4/1968 | Timmons | 166/277 |
| 3,572,450 | A | * | 3/1971 | Thompson | 175/76 |
| 4,612,987 | A | * | 9/1986 | Cheek | 166/212 |
| 4,616,703 | A | | 10/1986 | Laurent | |
| 4,819,760 | A | | 4/1989 | Petermann | |
| 4,869,324 | A | | 9/1989 | Holder | |
| 4,947,944 | A | * | 8/1990 | Coltman et al. | 175/73 |
| 4,960,173 | A | | 10/1990 | Cognevich | |
| 5,119,875 | A | | 6/1992 | Richard | |
| 5,358,048 | A | | 10/1994 | Brooks | |
| 5,366,020 | A | | 11/1994 | Berzin | |
| 5,615,741 | A | | 4/1997 | Coronado | |
| 5,685,369 | A | * | 11/1997 | Ellis et al. | 166/195 |
| 5,765,640 | A | | 6/1998 | Milne et al. | |
| 5,979,550 | A | | 11/1999 | Tessier | |
| 6,189,610 | B1 | * | 2/2001 | LaClare et al. | 166/208 |

FOREIGN PATENT DOCUMENTS

| | | |
|---|---|---|
| CA | 2292867 | 6/2001 |

* cited by examiner

*Primary Examiner*—David Bagnell
*Assistant Examiner*—Daniel P Stephenson
(74) *Attorney, Agent, or Firm*—Sean W. Goodwin

(57) ABSTRACT

A stabilizer is provided for stabilizing a rotary or progressive cavity pump suspended from production tubing in well casing. The stabilizer is connected between the production tubing and the pump. The stabilizer has a tubular body having a cylindrical wall and a longitudinal bore contiguous with the production tubing. A releasable sliding dog is disposed on the exterior of the tubular body and is operatively connected by a link to one or more pistons. Each piston is disposed in a piston housing that is in fluid communication with the bore of the tubular body. Circumferentially spaced-apart feet extend radially outwardly from the tubular body. In operation, actuating fluid pressure advances the pistons uphole, driving the sliding dog up one or more longitudinal outwardly extending ramps to brace against the casing, with the feet contacting the casing and bearing opposing reactive force. Preferably, the sliding dog and the feet form a three-point contact with the casing that arrests lateral movement in any direction. Under non-actuating pressure, upward drag on the sliding dog compresses the pistons, retracting the dog, and permitting removal of the stabilizer and pump.

23 Claims, 8 Drawing Sheets

ROTARY PUMP STABILIZER

FIELD OF THE INVENTION

The invention relates to a dynamic pressure-responsive apparatus used for the stabilization of tools suspended from production tubing, said tools being subject to undesirable lateral movement, and particularly tools subject to vibration in operation such as progressive cavity pumps.

BACKGROUND OF THE INVENTION

Apparatus are known for stabilizing various well tools which are suspended at the bottom of a production tubing string. An example of a tool which would benefit from stabilization is a rotary or progressive cavity pump ("PC pump"). A PC pump is located within an oil well, positioned at the bottom end of a production tubing string which extends down the casing of the well. The pump pressurizes well fluids and drives them up the bore of the production tubing string to the surface. The pump comprises a pump stator coupled to the production tubing string, and a rotor which is both suspended and rotationally driven by a sucker rod string extending through the production tubing string bore. The stator is held from reactive rotation by a tool anchored against the casing. Usually this anti-rotation tool or torque anchor is located at the base of the stator and typically applies serrated slips to grip against the casing.

The rotor is a helical element which rotates within a corresponding helical passage in the stator. Characteristically, the rotor does not rotate concentrically within the stator but instead scribes a circular or elliptical path. This causes vibration and oscillation of the sucker rod, the pump's stator and the tubing attached thereto.

The greater the pump flow, the greater is the vibration. This can lead to loosening of the slips and functional failure of the no-turn tool. Other problems include fatigue failure of the connection of the stator to the tubing or nearby tubing-to-tubing connections.

In the prior art, bow springs have typically been used to centralize and stabilize the stator and the supporting tubing. By design, the bow springs are radially flexible, in part to permit installation and removal through casing. Unfortunately, the spring's flexibility permits cyclic movement, resulting in fatigue and eventual failure of the springs.

Unitary tubing string centralizers generally position the tool in a concentric or central position in the well. While these centralizers may provide a positioning function, they are not effective as a tool-stabilizing means. The known centralizers are passive devices and do not actively contact the casing.

More sophisticated apparatus are known which more positively secure and position tools within a well. For example, in U.S. Pat. No. 2,490,350 to Grable, a centralizer is provided using mechanical linkages which lock radially outwardly to engage the casing. Each of a plurality of two-bar linkages is held tight to the outside of the tubing string with a retaining bolt. A longitudinal spring and longitudinal ratchet are arranged external to the tubing for pre-loading of one link with the potential to jack-knife the linkage outwardly, except for the restraining action of the retaining bolt. A radial plunger extends through the tubing wall to contact the linkage. The plunger has limited stroke. When the tubing string bore is pressurized, the plunger urges the linkage sufficiently outwardly to break the retaining bolt, permitting the spring to drive the linkage radially outwardly. The driven link engages the ratchet, ensuring the linkage movement is uni-directional.

In U.S. Pat. No. 4,960,173 to Cognevich, a tubular housing is also disclosed having mechanical linkages which are held tight to the housing during installation. The linkages are irreversibly deployed upon melting of a fusible link at downhole conditions. An annular compression spring actuates a telescoping sleeve which deploys a four-bar linkage and forcibly holds the linkage against the casing wall. Rollers on the ends of two of the linkages contact the casing wall for aiding in limited longitudinal movement of the tubular housing once the linkages are deployed. Gradual radial adjustment of the linkage is permitted by a fluid bleed to permit the telescoping sleeve to slowly retract during this movement. If the bleed fails and additional radial movement continues, a pin will shear, fully releasing the telescoping sleeve and linkage from the compression spring.

In summary, both Grable and Cognevitch disclose apparatus which: rely upon compression spring force alone to drive and hold the linkages radially outwardly; do not deploy or extend the linkage until after installation on the casing; result in an irreversible deployment; and in the case of Grable, do not permit movement or removal without damage to the linkage, and in the case of Cognevitch, limited movement is permitted but if the linkage cannot accept the movement required, a jarring action will shear a pin and irreversibly separate the compression spring from the linkage.

In Canadian Patent Application 2,296,867 to Tessier, a tubular stabilizing apparatus is disclosed having a sliding dog disposed in a longitudinal pocket formed in the exterior of the tubular body. The sliding dog is activated by pistons pivotally connected to the sliding dog whereby fluid pressure within the piston bore dynamically drives the pistons to move the sliding dog along a ramp formed within the pocket. The tip of the sliding dog is thereby driven upwardly and outwardly to contact and brace against the casing, with the opposite side of the tubular body contacting the casing.

While the stabilizing apparatus of Tessier provides several advantages over the prior art, under some circumstances, the two-point contact of the tip of the sliding dog and the opposing tubular body with the casing may not provide sufficient stabilization against movement transverse to the plane of contact.

There is, therefore, a need for an improved stabilizing apparatus.

SUMMARY OF THE INVENTION

A stabilizer is provided for securely and releasably stabilizing downhole tools suspended from a production tubing string containing fluid under varying pressure. Such a tool is associated with or is the source of lateral movement within the casing.

In a broad aspect of the invention, the stabilizer is positioned between a well tool, such as a PC pump, and the production tubing string. The stabilizer comprises a tubular body having a cylindrical wall and a longitudinal bore contiguous with that of the production tubing string. A releasable stabilizing means or assembly is disposed on the exterior of the tubular body that extends radially outward to contact the casing when actuated. At least two circumferentially spaced-apart feet extend radially outward from the tubular body to contact the casing when the stabilizer is actuated. More particularly, the angle between the stabilizer and the feet adjacent to the stabilizing means is greater than ninety degrees, preferably in the range of about 110 degrees to about 160 degrees, and most preferably about 120 degrees, such that the feet bear reactive force against the stabilizing means to substantially arrest lateral movement in any direction. Preferably, there are two feet equidistant from the stabilizing means and at an angle of about 120 degrees forming a three-point contact of the feet and the stabilizer with the casing.

In one embodiment, the stabilizer utilizes fluid pressure to actively and forcefully stabilize the tool against lateral movement in any direction. Further, when the fluid pressure diminishes, such as when no fluid is being produced, the apparatus may be readily repositioned, repeatedly installed or removed without irreversible alteration of the apparatus or peripheral damage. The apparatus is dynamically responsive so as to provide greater stabilizing force at higher fluid pressures, for instance, in the case of a PC pump tool, when the pump is pumping more vigorously.

Preferably, the stabilizing means comprises a radially outwardly extendable sliding dog operably connected to a fluid pressure-driven actuating means or actuator comprising one or more pistons, housed and moveable within piston bores formed in a piston housing. The piston bore is in communication with the bore of the tubular body so that it is pressurized dynamically with fluid. Fluid pressure causes the pistons to advance uphole, driving the sliding dog upward to be driven up at least one ramp, so as to move radially outwardly to contact and brace against the casing, with the radial force being proportional with the fluid pressure. Preferably, there are two longitudinally spaced-apart ramps and the sliding dog and the pistons are connected by a pivotable link such that the sliding dog is substantially parallel with the casing when actuated.

The stabilizer can also include a shear pin extending thought the wall of the tubular body and the stabilizing means to prevent pre-actuation of the stabilizer, such as when the stabilizer is being installed within the well. Further, stops can be provided that limit longitudinal movement of the stabilizing means or actuating means to obviate a possible jamming of the stabilizer in the well.

BRIEF DESCRIPTION OF THE DRAWINGS

In drawings which are intended to illustrate embodiments of the invention and which are not intended to limit the scope of the invention.

DETAILED DESCRIPTION OF THE PREFERRED EMBODIMENT

Figure 1:
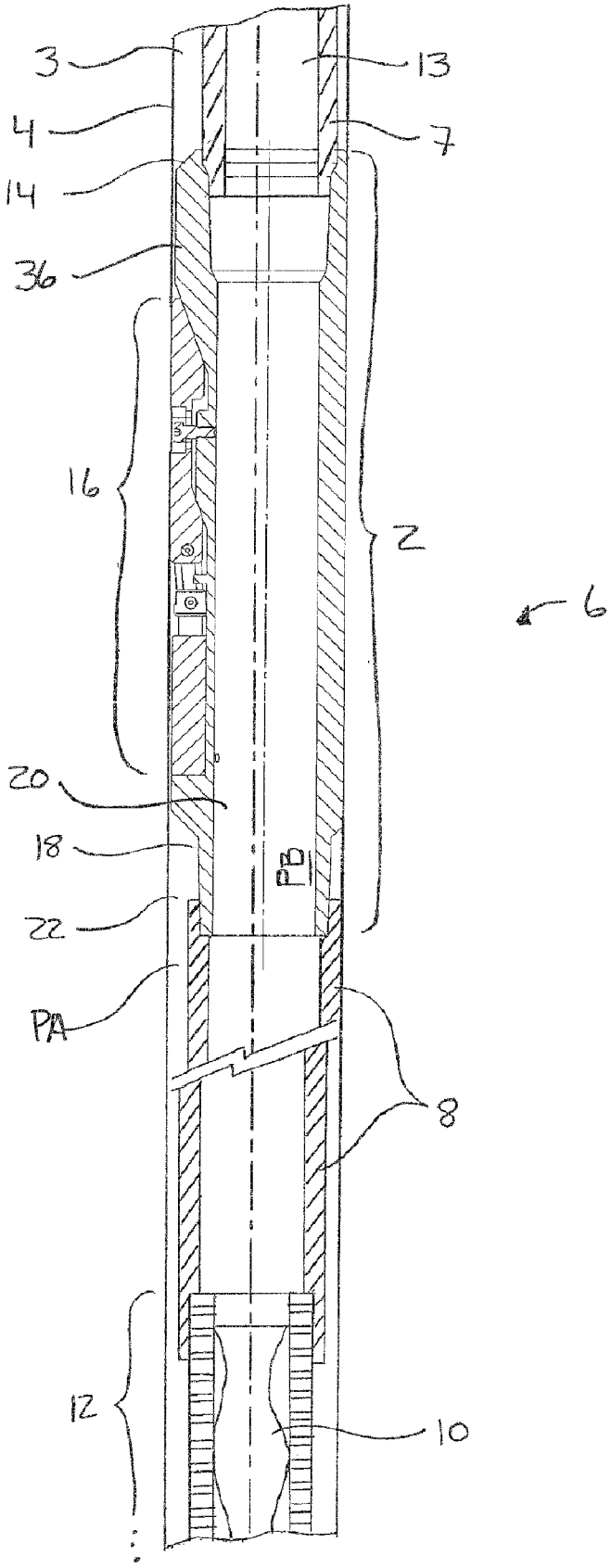
FIG. 1 is a cross-sectional view of the lower end of a well casing with the stator of a PC pump located therein, the pump having an embodiment of the stabilizer of the present invention connected thereabove for stabilizing the pump and tubing within the casing, and with the cross-section of the stabilizer taken along line I-I of FIG. 3B.

Having reference to FIG. 1, one embodiment of a stabilizer 2 is located within the bore 3 of the casing 4 of a completed oil well 6. The stabilizer 2 is suspended from a production tubing string 7 and connected to a downhole well tool such as a rotary pump. Shown in this embodiment, the stabilizer 2 is connected co-axially via a pup joint 8 to the stator 10 of a progressive cavity pump ("PC pump") 12 located within the well casing 4. The PC pump 12 is therefore suspended from the production tubing string 7 by connection through the stabilizer 2. In operation, the PC pump 12 pressurizes well fluids and directs them up the bore 13 of the production tubing string 7 to the surface.

In the context of a PC pump 12, its stator 10 is secured against reactive torque rotation in the casing 4. While not shown, it is understood that the stator 10 is secured using an anti-rotation tool or a torque anchor usually positioned at the lower end of the PC pump 12. The rotor of the PC pump 12, which is not shown for clarity of the other components, would be typically suspended and rotationally driven from a sucker rod, also not shown.

Figure 2:
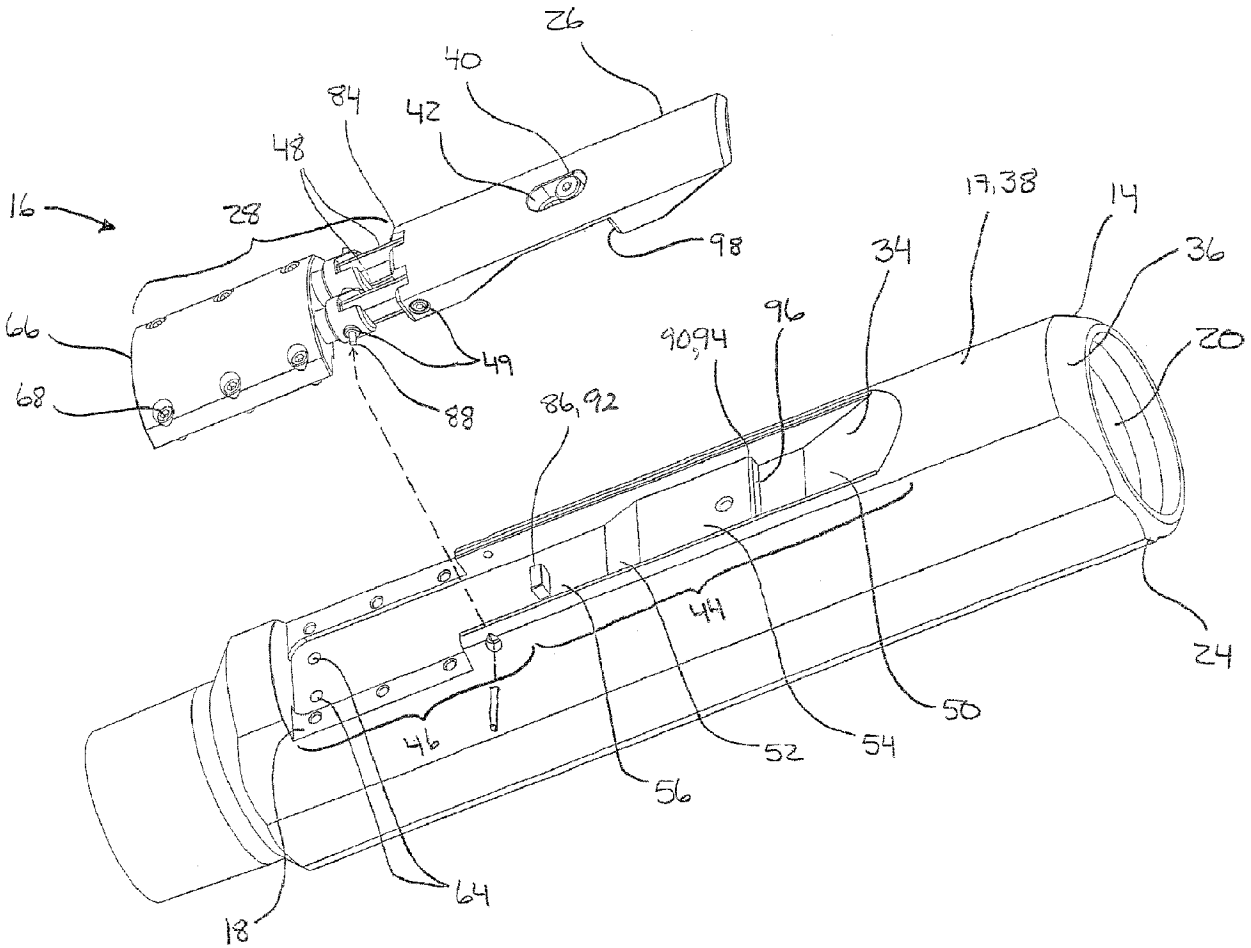
FIG. 2 is a partially exploded perspective view the stabilizer according to FIG. 1.
Figure 3A:
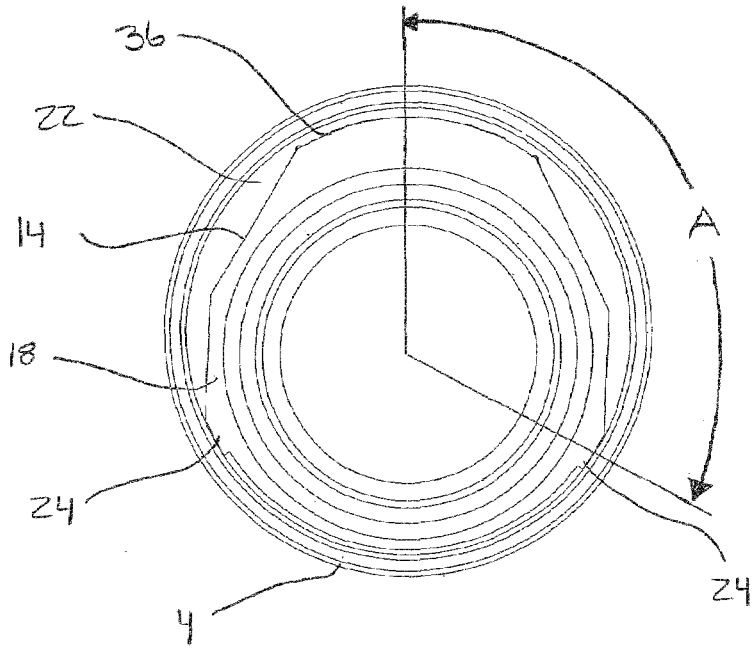
FIGS. 3A and 3B are top end views of the stabilizer taken along the lines III-III of FIGS. 4A and 4B, respectively, with the stabilizer installed in a well casing and shown in the non-actuated condition (FIG. 3A) and actuated condition (FIG. 3B)
Figure 3B:
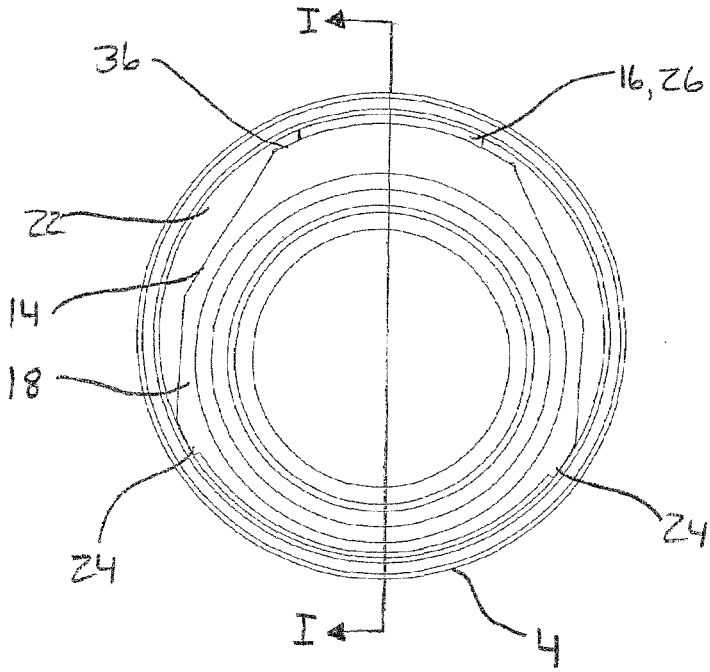

Referring also to FIGS. 2, 3A and 3B, the stabilizer 2 comprises a tubular body 14 and a releasable stabilizing means or assembly 16 disposed on the exterior 17 of the tubular body 14. The tubular body 14 has a contiguous annular wall 18 forming a longitudinal bore 20 extending therethrough for passing pressurized well fluids pumped from the PC pump 12, through the tubular body bore 20 and up the production tubing string bore 13 to the surface. An annular space 22 is formed between the tubular body 14 and the casing 4.

The releasable stabilizing means 16 is radially outwardly extendible to engage the casing 4. Actuation such as by fluid pressure in the tubular body bore 20 (PB), which is greater than the pressure in the annulus 22 (PA), forcibly actuates and braces the stabilizing means 16 against the casing 4 and thereby jams the tubular body 14 against the opposing side of the well casing 4 to substantially arrest oscillatory movement of the PC pump stator 10. The stabilizing means 16 is dynamically actuated by fluid pressure which makes the stabilizing capability stronger as the fluid pressure PB increases.

In greater detail, the tubular body 14 is profiled to provide at least two longitudinally extending and circumferentially spaced-apart protrusions or feet 24. The effective diameter of the stabilizer 2 before actuation is less than the diameter of the casing bore 3 to permit installation of the stabilizer 2 therein. The angle A between the stabilizing means 16 and each of the feet 24 adjacent to the stabilizing means 16 is greater than 90 degrees, preferably in the range of about 110 degrees to about 160 degrees, such that when the stabilizing means 16 is actuated, the stabilizing means 16 and the feet 24 contact the casing. In other words, each of the feet 24 need to bear opposing reactive force against the stabilizing means 16 when actuated. Preferably, there are two feet 24 equidistant from the stabilizing means 16 and the angle is about 120 degrees, thereby forming a three point contact of the stabilizing means 16 and the feet 24 with the casing 4 to substantially arrest lateral movement of the PC pump 10 in any direction.

It is to be noted that while FIG. 3A shows the feet 24 contacting the casing 4 in the non-actuated position, this is only to more clearly show the radial movement of the stabilizing means 16 within the annular space 22 upon actuation. In fact, the stabilizer 2 is loosely and randomly fit within the casing bore 3 until it is actuated.

The stabilizing means 16 comprises a sliding dog 26 and a fluid pressure-driven actuating means or actuator 28. Having further reference to FIGS. 4A, 4B, 5A and 5B, the sliding dog 26 is operable between a retracted position (FIGS. 4A, 5A) and a radially outwardly extended position (FIGS. 4B, 5B) for engagement of the sliding dog 26 with the casing 4.

The sliding dog 26 and actuating means 28 are positioned in a longitudinally extending pocket 34 formed in a thickened portion 36 of the annular wall 18. The pocket 34 extends radially inwardly or is recessed from an outer surface 38 of the tubular body 14. More particularly and as best seen in FIG. 2, the pocket 34 has an uphole portion 44 into which the sliding dog 26 is disposed and a downhole portion 46 into which the actuating means 28 is disposed. The sliding dog 26 and actuating means 28 are operatively connected by one or more links 48 positioned therebetween and pivotally attached thereto with pins 49, such as a roll pins. Each link 48 is a double link having first and second ends 48*a*, 48*b* to enable both axial and radial displacement of the sliding dog 26.

The uphole portion 44 includes a first, uphole ramp 50 and a parallel second, downhole ramp 52 longitudinally spaced by a land 54 from the first ramp 50. The ramps 50, 52 extend longitudinally and outwardly from the floor 56 of the pocket 34. In operation, as shown in FIGS. 4B and 5B, when the tubular body bore 20 is pressurized for actuation (PB>>PA), the actuating means 28 is advanced longitudinally uphole for driving the sliding dog 26 against the first and second ramps 50, 52. The ramps 50, 52 deflect the sliding dog 26 radially outward, similar to the action of a parallelogram linkage, as the links 48 pivot relative to the actuating means 28 and the sliding dog 26. Eventually, as the actuating means 28 advances, the sliding dog 26 radially contacts and braces against the casing 4, with the sliding dog 26 being substantially parallel to the casing 4.

To prevent the sliding dog 26 from falling out of the pocket 34 during handling outside of the casing 4, while also subsequently permitting movement of the sliding dog 26 as required, a shoulder screw 40 is affixed to the tubular body 14 and set within a longitudinally elongated screw hole 42.

Figure 6:
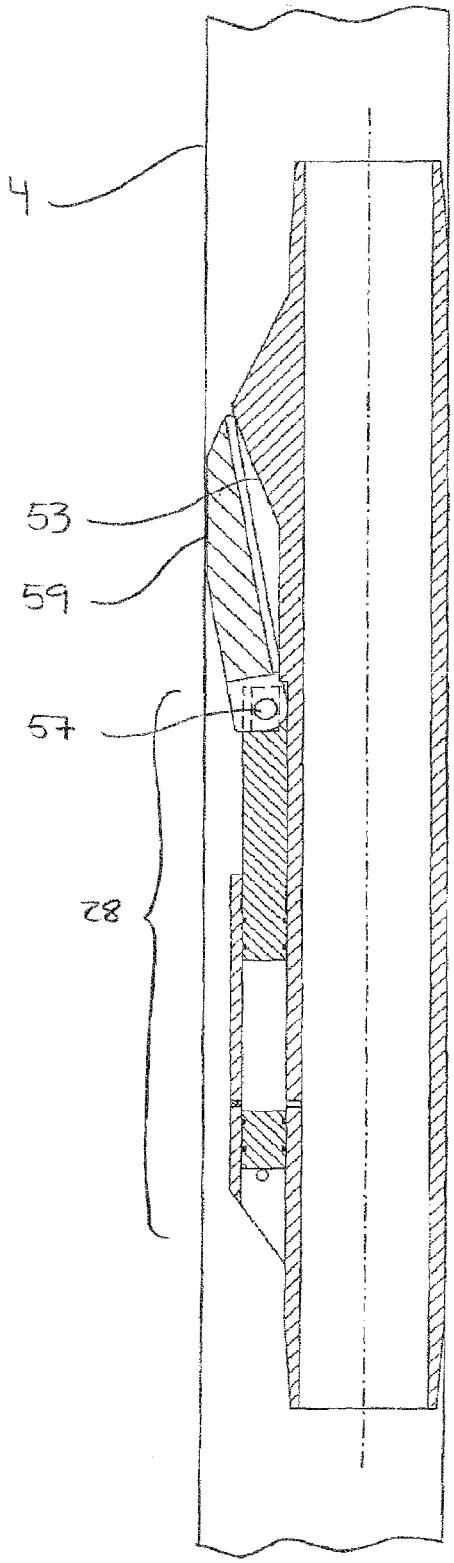
FIG. 6 is a cross-sectional view of an alternative embodiment of a stabilizer according to the present invention with the stabilizer installed in a well casing and in the actuated condition.

In an alternative embodiment, as shown in FIG. 6, there is a single ramp 53. Further, the sliding dog 26 can be pivotally connected to the actuating means 28 by a hinge 57, in which case the sliding dog will pivot outwardly for contact of a tip 59 of the sliding dog 26 with the casing 4. Such an apparatus is described in Canadian Patent Application No. 2,292,867 to Tessier and is herein incorporated by reference.

The actuating means 28 is an arrangement of one or more longitudinally-extending pistons 60 and piston bores 62, and ports 64 extending between each piston bore 62 and the bore 20 of the tubular body 14.

In detail, each piston bore 62 is drilled in a piston housing 66 that is fit within the downhole portion 46 of the pocket 34. The piston housing 66 is secured to the tubular body 14 by screws 68 or other suitable means. Each piston bore 62 has a first, uphole end 70 that opens into the pocket's uphole portion 44 and a second, downhole end 72 that communicates with the tubular body bore 20 through the ports 64. The ports 64 are drilled through the piston housing 66 and the annular wall 18 to form a contiguous port 64 when the housing 66 is fit within the pocket 34. An O-ring 74 is fit between the piston housing 66 and the annular wall 18 to form a fluid seal through the ports 64.

A piston 60 is disposed in each piston bore 62 and is longitudinally movable between the bore's first and second ends 70, 72. Each piston 60 has an uphole, pocket end 76 and a downhole, pressure end 78. A double O-ring seal 80 is fit to the downhole end 78 of each piston 60 to prevent pressurizing fluid from flowing out of the piston bore 62, thereby forming a pressure chamber 82 at the second end 72 of the piston bore 62. The uphole end 76 of each piston 60 is pivotally connected to the first end 48*a* the link 48, with the second end 48*b* of the link 48 being pivotally connected to a downhole end 84 of the sliding dog 26.

When fluid pressure PB within the tubular body bore 20 is raised above the pressure PA outside the stabilizer 2, such as when a PC pump operates, the differential pressure (PB-PA) causes each piston 60 to advance in the uphole direction, actuating the sliding dog 26.

The greater is the fluid pressure PB in the bore 20, the greater is the differential pressure (PB-PA), the greater is the force applied to each piston 60 and the greater is the force applied by the sliding dog 26 against the casing 4. Serendipitously, as the downhole tool, such as a PC pump, works harder and results in greater vibration, the bore pressure PB also increases and the sliding dog 26 provides even greater stabilizing force. At the same time, an extension stop 86 is positioned to contact the uphole end 76 of each piston 60 to limit the piston 60 from over-stroking and thereby obviating a possible jamming of the stabilizer 2 in the casing 4.

In an example case where each of two pistons 60 and piston bores 62 are ¾ inch in diameter, differential fluid pressures (PB-PA) of 2000 psi(g) result in actuating forces of 1770 pounds, and radial forces of 8850 pounds being applied against the casing wall.

Figure 4A:
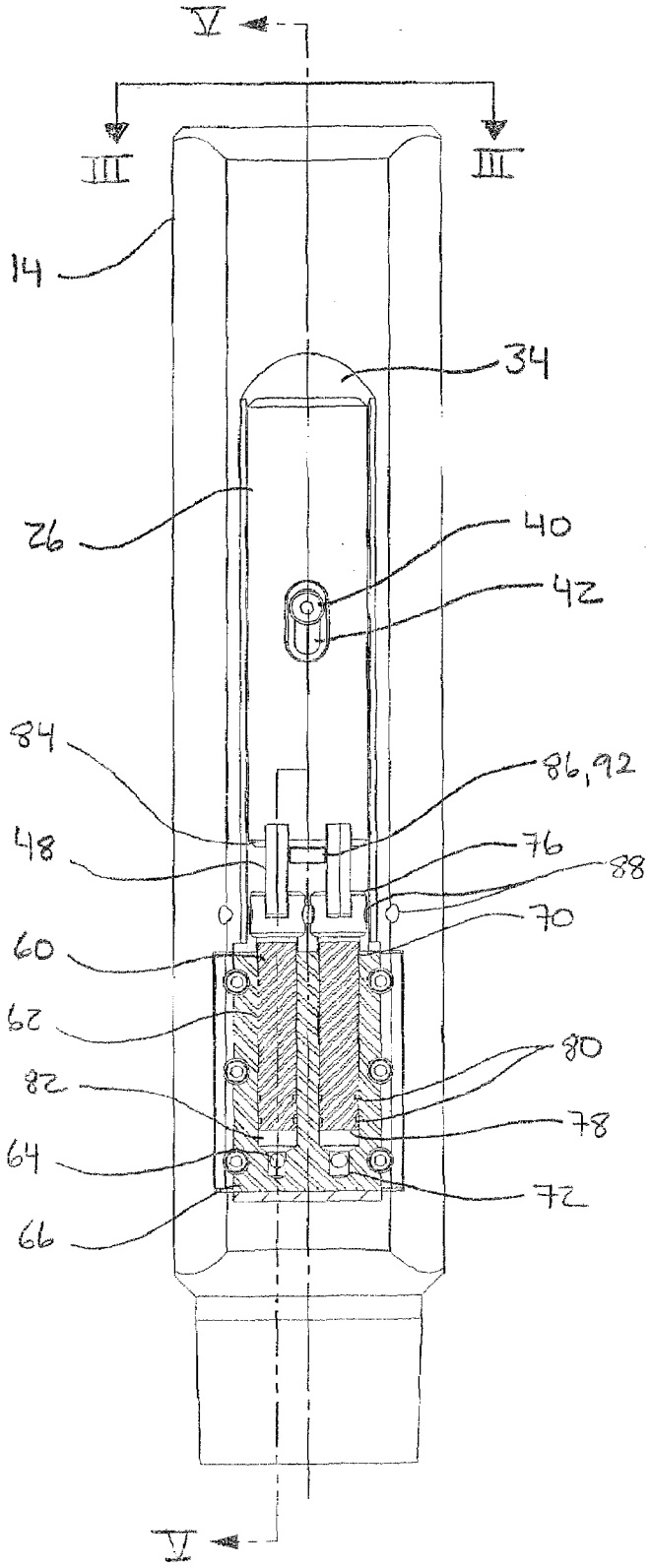
FIGS. 4A and 4B are elevational views of the stabilizer according to FIG. 1, with part of the piston housing cut away and shown in the non-actuated condition (FIG. 4A) and actuated condition (FIG. 4B)
Figure 4B:
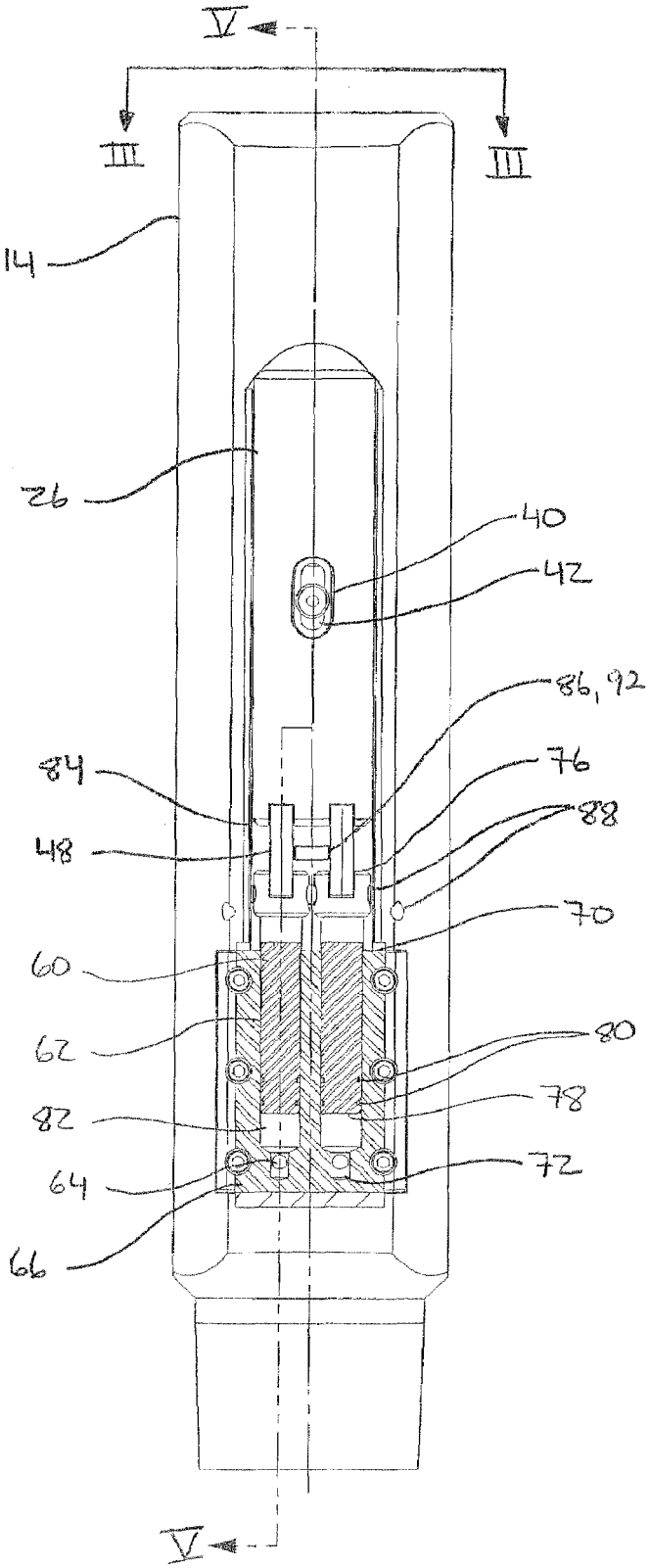
Figure 5A:
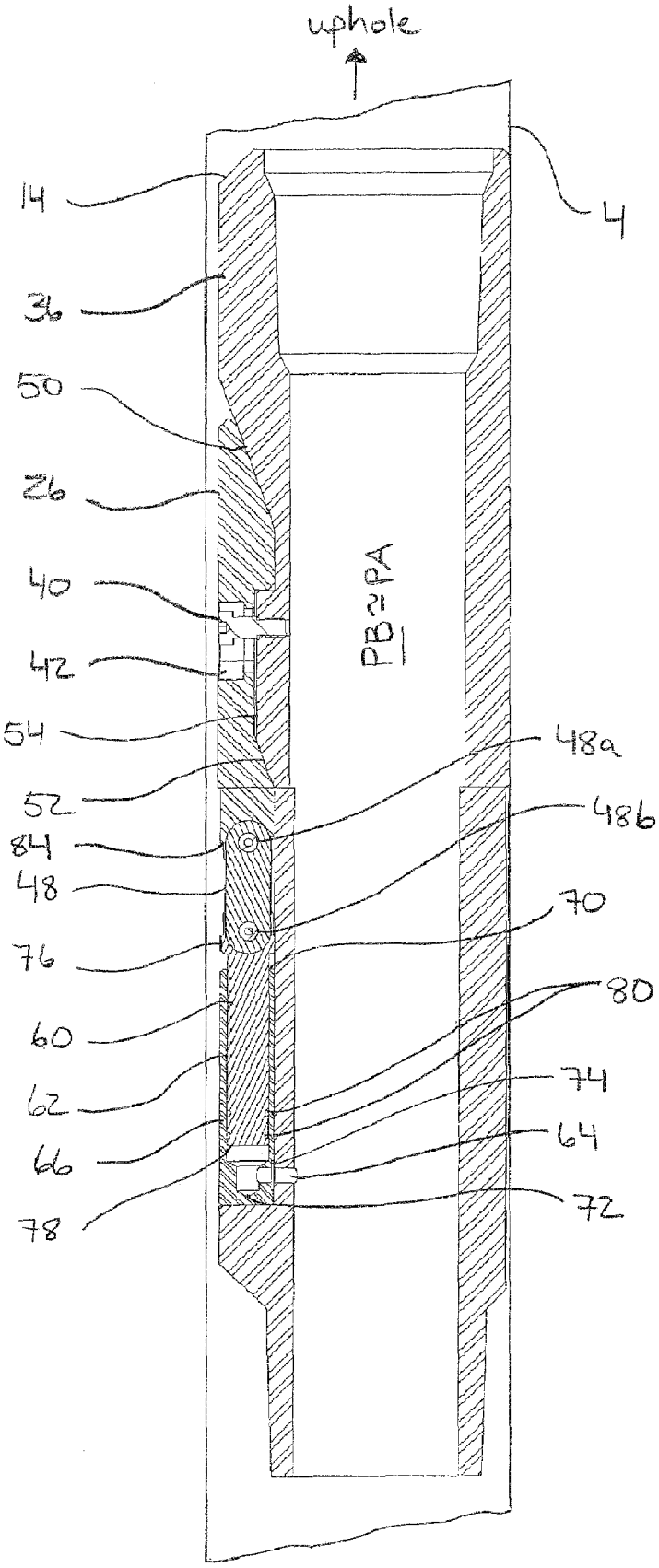
FIGS. 5A and 5B are cross-sectional views taken along lines V-V of FIGS. 4A and 4B, respectively, with the stabilizer installed in a well casing.
Figure 5B:
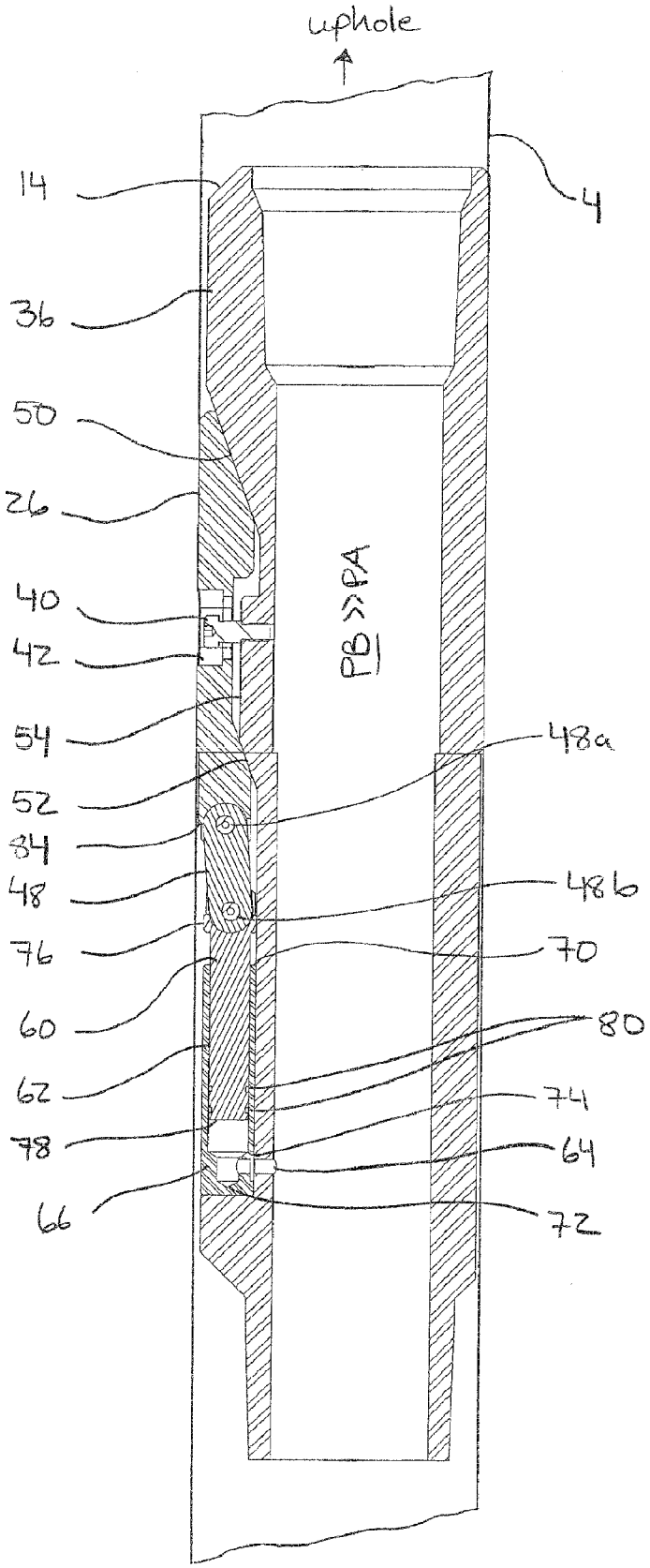

As best seen in FIGS. 2, 4A and 4B, a shear pin 88 extending through at least one of the pins 49 and the annular wall 18 prevents premature actuation of the stabilizer 2 as it is inserted into the casing 4. The shear pin 88 is constructed of material that is capable of supporting sufficient load to prevent premature actuation, but which will shear at actuating forces, as shown in FIGS. 4A and 4B. In the above example case, the shear pin 88 can be a nylon shear pin capable of supporting a load of 400 lbs.

When it is necessary to move or remove the downhole tool or stabilizer 2 from the casing 4, the pressure is reduced in the tubular body bore 20. In the case of a PC pump, pumping is stopped and the pressure differential between the tubular body bore 20 and the annulus 22 falls to reach equilibrium (PB substantially equals PA). The actuating means 28 goes slack and the force of the sliding dog 26 against the casing 4 drops, releasing the dog 26 and enabling movement of the stabilizer 2. Further, when the stabilizer 2 is being removed from the casing 4, upward movement drags the dog 26 against the casing 4 also forces the dog 26 back into the pocket 34 and the pistons 60 back in their bores 62.

To ensure a snag-free profile or line for ease of removal, uphole and downhole retraction stops 90, 92 are provided that limit the downhole movement of the sliding dog 26, as particularly seen in FIGS. 2, 4A and 4B. The uphole retraction stop 90 is formed by the uphole end 94 of the land 54 between first and second ramps 50, 52. The uphole retraction stop 90 has an upwardly facing radial surface 96 extending to the pocket floor 56 that contacts a downwardly facing radial surface 98 of the sliding dog 26. The downhole retraction stop 92 projects outwardly from the pocket floor 56 and is positioned to contact the downhole end 84 of the sliding dog 26. Conveniently, the downhole retraction stop 92 can correspond to the extension stop 86.

Preferably the tubular body 14 is cast or machined in one piece. The pocket 34 is recessed into wall 18, such as being cast in place or formed through a process such as milling. The following are examples of materials suitable for use for the various stabilizer components.

| Component | material |
|---|---|
| Tubular body 14 | Carbon steel |
| Piston housing 66 | 302 stainless steel |
| Sliding dog 26 | HTSR |
| Piston 60 | 17-4 stainless PH, grade HL50 |
| Links 48 | HTSR |
| Pins 49 | stainless steel |
| O-rings 74, 80 | Viton 90 |

What is claimed is:

1. A stabilizer for stabilizing a well tool within a subterranean casing, the well tool being suspended from a production tubing and having a longitudinal bore for containing pressurized well fluid therein, the stabilizer comprising:

a tubular body having a cylindrical wall and a longitudinal bore extending therethrough, the tubular body positioned within the casing between the well tool and the production tubing, the bore of the tubular body in communication with the longitudinal bore of the production tubing;

a releasable stabilizing means disposed on the tubular body, the stabilizing means being actuatable to extend radially outward for contacting the casing, the stabilizing means comprising;

a recessed pocket formed in the wall, the pocket having an uphole portion forming at least one radially outwardly extending ramp, and a downhole portion;

a radially outwardly extendable sliding dog disposed within the uphole portion, the sliding dog having a first position wherein the sliding dog is retracted within the pocket and a second position wherein the sliding dog is radially outwardly extended;

a downhole retraction stop positioned between the sliding dog and the actuating means, the downhole retraction stop limiting the downhole movement of the sliding dog; and actuating means positioned within the downhole portion and operatively connected to the sliding dog, the actuating means in fluid communication with the longitudinal bore of the tubular body whereby the fluid pressure causes the actuating means to advance uphole, driving the sliding dog longitudinally along the at least one ramp to move the sliding dog from the first position to the second position to contact the casing and stabilize the well tool, the force of contact being substantially proportional to the fluid pressure, and at least two circumferentially spaced-apart feet extending radially outward from the tubular body, an angle between the stabilizing means and each of the feet adjacent to the stabilizing means being greater than 90 degrees, wherein the feet and the stabilizing means contact the casing when the stabilizing means is actuated.

2. The stabilizer of claim 1 wherein the angle is in the range of about 110 degrees to 160 degrees.

3. The stabilizer of claim 1 wherein the angle is about 120 degrees.

4. The stabilizer of claim 1 wherein there are two feet equidistant from the stabilizing means, wherein the angle is about 120 degrees, and wherein the feet and the stabilizing means form a three-point contact with the casing when the stabilizing means is actuated.

5. The stabilizer of claim 1 wherein the actuating means is connected to the sliding dog by a link, and wherein the sliding dog is substantially parallel with the casing when actuated.

6. The stabilizer of claim 1 wherein the uphole portion of the pocket forms two longitudinally spaced and parallel ramps.

7. The stabilizer of claim 6 further comprising an uphole retraction stop between the two ramps, the uphole retraction stop having an upwardly facing surface for contacting a downwardly facing surface of the sliding dog when in the first position.

8. The stabilizer of claim 1 further comprising:

an extension stop positioned between the sliding dog and the actuating means, the extension stop limiting the uphole movement of the actuating means.

9. The stabilizer of claim 1 further comprising:

an extension stop positioned between the sliding dog and the actuating means, the extension stop limiting the uphole movement of the actuating means, wherein the downhole retraction stop and the extension stop are the same.

10. The stabilizer of claim 1 wherein the actuating means comprises:

one or more piston bores formed in a piston housing, the piston housing securely fit within the downhole portion of the pocket, each piston bore having a first downhole end in communication with the longitudinal bore of the tubular body and a second end open to the one or more pockets; and a piston longitudinally moveable within each piston bore and having an uphole end operatively connected to the sliding dog, the fluid pressure within the longitudinal born of the tubular body pressurizing each piston bore causing each piston to advance uphole to drive the sliding dog.

11. The stabilizer of claim 10 wherein there am two piston bores, wherein the pistons are connected to the sliding dog by a link having a first end pivotally connected to the piston and a second end pivotally connected to the sliding dog, and wherein the uphole portion forms two longitudinally spaced and parallel ramps.

12. The stabilizer of claim 1 further comprising a shear pin extending through the wall and the stabilizing means to prevent actuation of the apparatus in the absence of actuating fluid pressure.

13. The stabilizer of claim 1 wherein the well tool being stabilized is a fluid pump that pressurizes fluid within the bore of the tubular body.

14. The stabilizer of claim 13 wherein the pump is a rotary pump.

15. The stabilizer of claim 13 wherein the pump is a progressive cavity pump.

16. A stabilizer for stabilizing a well tool within a subterranean casing, the well tool being suspended from a production tubing and having a longitudinal bore for containing the pressurized well fluid therein, the stabilizer comprising:

a tubular body having a cylindrical wall and a longitudinal bore extending therethrough, the tubular body positioned within the casing between the well tool and the production tubing, the bore of the tubular body in communication with the bore of the production tubing;

a releasable stabilizing assembly disposed on the tubular body, the stabilizing assembly being actuatable to extend radially outward for contacting the casing, the stabilizing assembly comprising:

a recessed pocket formed in the wall, the pocket having an uphole portion forming at least one radially outwardly extending ramp, and a downhole portion;

a radially outwardly extendable sliding dog disposed within the uphole portion, the sliding dog having a first position wherein the sliding dog is retracted within the pocket and a second position wherein the sliding dog is radially outwardly extended;

a downhole retraction stop positioned between the sliding dog and the actuator, the downhole retraction stop limiting the downhole movement of the sliding dog;

an actuator positioned within the downhole portion and operatively connected to the sliding dog, the actuator in fluid communication with the longitudinal bore of the tubular body whereby the fluid pressure causes the actuator to advance uphole, driving the sliding dog longitudinally along the at least one radially outwardly extended ramp to move the sliding dog from the first position to the second position to contact the casing and stabilize the well tool, the force of contact being substantially proportional to the fluid pressure, and at least two circumferentially spaced-apart feet extending radially outward from the tubular body, an angle between the stabilizing assembly and each of the feet adjacent to the stabilizing assembly being greater than 90 degrees, wherein the feet and the stabilizing assembly contacting the casing when the stabilizing assembly is actuated.

17. The stabilizer of claim 16 wherein the angle is in the range of about 110 degrees to 160 degrees.

18. The stabilizer of claim 16 wherein the angle is about 120 degrees.

19. The stabilizer of claim 16 wherein there are two feet equidistant from the stabilizing assembly wherein the angle is about 120 degrees, and wherein the feet and the stabilizing assembly form a three-point contact with the casing when the stabilizing assembly is actuated.

20. The stabilizer of claim 16 wherein the uphole portion of the pocket forms two longitudinally spaced and parallel ramps.

21. The stabilizer of claim 16 wherein the actuator comprises:

one or more piston bores formed in a piston housing, the piston housing securely fit within the downhole portion of the pocket, each piston bore having a first downhole end in communication with the bore of the tubular body and a second end open to the one or more pockets; and a piston longitudinally moveable within each piston bore and having an uphole end operatively connected to the sliding dog, the fluid pressure within the bore of the tubular body pressurizing each piston bore causing each piston to advance uphole to drive the sliding dog.

22. The stabilizer of claim 16 wherein there are two piston bores, wherein the pistons are connected to the sliding dog by a link having a first end pivotally connected to the piston and a second end pivotally connected to the sliding dog, and wherein the uphole portion forms two longitudinally spaced and parallel ramps.

23. The stabilizer of claim 16 further comprising an extension stop positioned between the sliding dog and the actuator, the extension stop limiting the uphole movement of the actuator, wherein the downhole retraction stop and the extension stop are the same.

* * * * *